United States Patent [19]

Keeny

[11] 4,092,915

[45] June 6, 1978

[54] OIL HEATED DOUBLE FACER PLATEN

[75] Inventor: Thomas R. Keeny, Lindenwold, N.J.

[73] Assignee: Molins Machine Company, Inc., Cherry Hill, N.J.

[21] Appl. No.: 767,610

[22] Filed: Feb. 10, 1977

Related U.S. Application Data

[63] Continuation-in-part of Ser. No. 614,050, Sep. 17, 1975, Pat. No. 4,023,481.

[51] Int. Cl.[2] ..... B30B 15/34

[52] U.S. Cl. ..... 100/93 P; 156/583; 425/406

[58] Field of Search ..... 100/93 P; 156/210, 583; 425/383, 384, 233, 406

[56] References Cited

U.S. PATENT DOCUMENTS

| | | | |
|---|---|---|---|
| 3,551,952 | 1/1971 | Morse | 100/93 P |
| 3,607,523 | 9/1971 | McGirr | 156/210 |
| 3,968,296 | 7/1976 | Whitby | 156/583 |
| 4,023,481 | 5/1977 | Keeby | 100/93 P |

*Primary Examiner*—Edward J. McCarthy
*Attorney, Agent, or Firm*—Seidel, Gonda & Goldhammer

[57] ABSTRACT

A double facer platen is constructed so as to utilize a liquid heating medium which flows through a chamber containing a labyrinth defining a flow passage whose cross-sectional area decreases in the direction of flow from an inlet toward an outlet. The platen is adapted for use with liquids which have a temperature in excess of 400° F. and a pump pressure of about 50 psi. The platen is supported by a beam having a temperature control means for compensating for any temperature difference between the upper and lower plates of the platen.

11 Claims, 10 Drawing Figures

OIL HEATED DOUBLE FACER PLATEN

RELATED CASE

This application is a continuation-in-part of application Ser. No. 614,050 filed on Sept. 17, 1975 for "Double Facer Platen," now U.S. Pat. No. 4,023,481.

BACKGROUND OF THE INVENTION

The subject matter involved herein is broadly classified in class 156, subclass 210. Representative prior art is exemplified by U.S. Pat. No. 3,607,523 and the references cited in said co-pending application Ser. No. 614,050.

For many years, the platens of a double facer were heated by steam. Steam heat has certain disadvantages such as structural considerations due to the high pressure of steam when steam is at the temperature used in a double facer machine. Each steam heated platen is a potential source of danger when in operation due to the high pressure and the compressed state of the steam. Further, there is a limit to the practical upper temperature range for steam when it is used as a heat transfer medium, so that even if the temperature were raised to the superheated range, insufficient heat would be transferred to warrant a corresponding increase in the operating speed of the single facer.

When a relatively cool web of paperboard is placed in contact with the surface of a thin, elongated platen, such as the platen in said copending patent application, the temperature of the upper plate is reduced. As the upper plate is cooled by transfer of heat to the web, its length is reduced thereby causing the ends of the platen to curve upward. If the center of the platen is below the elevation of the ends, the outer areas of the corrugated paperboard will be compressed by the weight of the conventional overlying belt and the ballast rollers. In like manner, the central area of the paperboard will lack contact with the platen and wet board will result.

Accordingly, there has been great need for a double facer platen which will maintain a substantially flat upper surface irrespective of the heat load imposed by the paperboard web. This need exists in both steam heated cast iron chests and fabricated steel platens. The higher temperatures prevailing in the liquid heated double facer, however, have made the problem more acute. This invention recognizes the source of the problem and presents a variety of solutions.

SUMMARY OF THE INVENTION

The liquid heated platen for use in a double facer in accordance with the present invention is constructed in a manner so as to have a planar outer surface on a main plate for transferring heat to a web in contact therewith. The main plate is connected to a lower plate therebelow by a peripheral spacer and sealed to said plates to thereby define a shallow, liquid-tight chamber. The chamber is provided with an inlet and an outlet. The chamber inlet is preferably closer to an upstream portion of said plates as compared with said outlet.

The liquid heated platen of the present invention is rigid as a result of beam means connected to the lower plate for maintaining the plates flat. A means is provided in the chamber to divide the chamber into a labyrinthine flow passage for the liquid which decreases in cross-sectional area from said inlet to said outlet. A temperature modulating means is provided to compensate for any temperature differences between said plates.

The liquid heated platen of the present invention will enable the double facer machine to be operated at speeds up to 30% greater than the speed of a double facer using steam heated platens. When using a liquid heating medium, such as oil, the vapor pressure is only about 2 psi at 450° F. and a pump is used for circulation. Whereas with steam, the temperature and pressure increase simulataneously at different rates. For example, oil can have a temperature of 450° F. at a pump pressure of 50 psi while saturated steam at the same temperature will result in pressures in excess of 400 psi.

It is an object of the present invention to provide a liquid heated platen for a double facer to facilitate attainment of higher temperatures with lower pressures as compared with steam and various advantages resulting therefrom such as savings in installation, savings in maintenance, and which compensates for any temperature difference between the major surfaces of said platen.

It is another object of the present invention to provide a double facer platen which permits the manufacture of better quality corrugated board at higher operating speeds than heretofore. Other objects appear hereinafter.

For the purpose of illustrating the invention, there is shown in the drawings a form which is presently preferred; it being understood, however, that this invention is not limited to the precise arrangements and instrumentalities shown.

Figure 1:
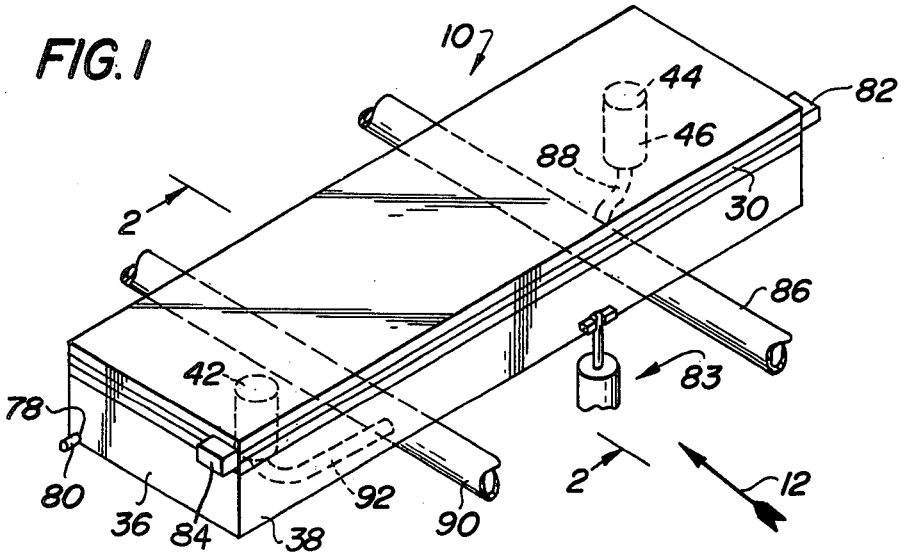
FIG. 1 is a perspective view of a platen in accordance with the present invention on a reduced scale.

Referring to the drawings in detail, wherein like numerals indicate like elements, there is shown in FIGS. 1–6 a liquid heated platen 10 for use in a double facer machine structurally interrelated with other components of the double facer such as is shown in the abovementioned U.S. Pat. No. 3,607,523.

The liquid heated platen 10 is adapted to be installed in the double facer with the components thereof arranged to transfer heat to a web travelling in the direction of arrow 12. Thus, the platen 10 has an upstream portion and a downstream portion as related to the direction of arrow 12.

The upper surface of the platen 10 is defined by an elongated main plate 26 having a preferred thickness in excess of ½ inch and having a planar top surface. A lower plate 28 has substantially the same peripheral dimensions as plate 26 but may be thinner than plate 26.

A peripheral spacer 30 separates the plates 26 and 28 to define a chamber 40 therebetween. Spacer 30 is sealed to the plates 26 and 28 in any convenient manner. Such sealing of spacer 30 is preferably attained by welding. Spacer 30 may also be an integral flange on one of said plates.

A platen 10 is typically provided with a length of 85–110 inches. The platen 10 is rendered rigid by longitudinally extending beam means. The beam means is preferably in the form of I-beams 32, 34 which extend for the full length of the platen 10 along opposite sides. The beams 32, 34 are preferably joined to the lower plate 28 by welding. Metal end walls 36 and metal side walls 38 may be provided on the platen 10 to stiffen and obscure the beams 32 and 34. Beams 32, 34 may be C-shaped or have some other shape instead of an I-shape.

The chamber 40 is shallow. In a typical embodiment of the present invention, chamber 40 has a vertical height of about ½ inch. Chamber 40 has an inlet 42 and an outlet 44 spaced from one another. Preferably, the inlet and outlet are spaced inwardly from the periphery of chamber 40 so as to be surrounded by a flow passage.

Figure 6:
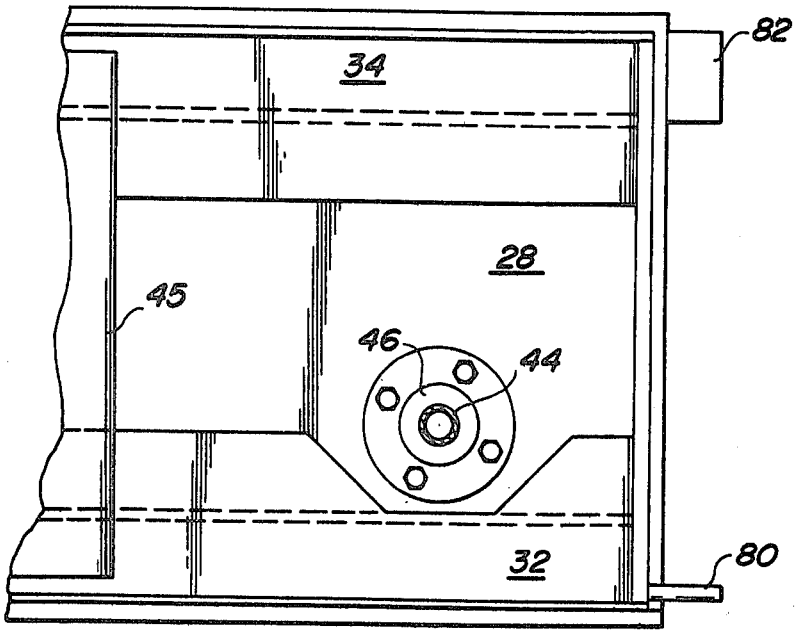
FIG. 6 is a partial bottom view.

Each of the inlet and outlet has a pipe extending therefrom in a vertical direction to an elevation at or below the elevation of the beams 32, 34 for ease of access of coupling. Thus, the outlet 44 is provided with a pipe 46. As shown in FIG. 6, the beam 32 is provided with a cut-out portion to accommodate the pipe 46 and its mounting flange. The beams 32, 34 are transversely innerconnected by one or more brace plates 45.

Figure 3:
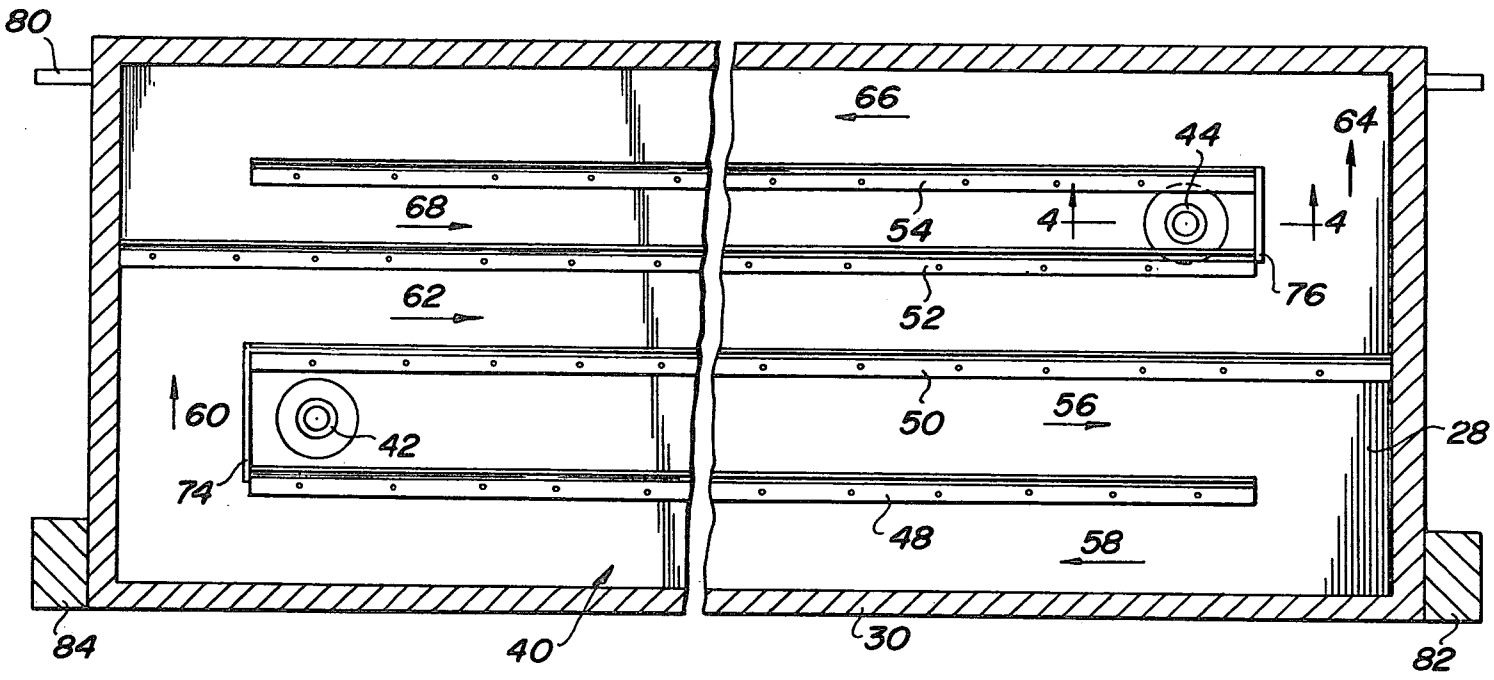
FIG. 3 is a sectional view taken along the line 3—3 in FIG. 2.
Figure 4:
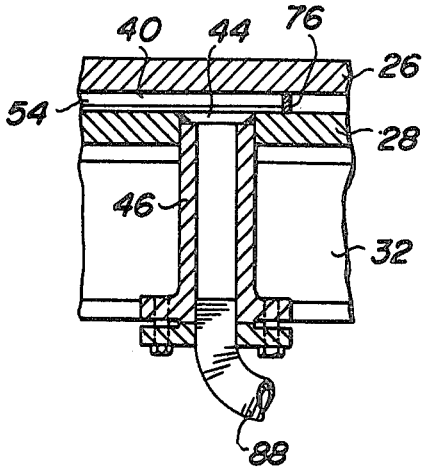
FIG. 4 is a sectional view taken along the line 4—4 in FIG. 3.
Figure 5:
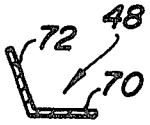
FIG. 5 is a cross-sectional view of a divider.

The chamber 40, as shown more clearly in FIG. 3, is provided with a labyrinthine passage extending from the inlet 42 to the outlet 44. Such division of the chamber 40 is attained by means of dividers 48, 50, 52 and 54. The dividers 48–54 are identical in cross-section as shown in FIG. 5. Thus, divider 48 includes a horizontally disposed leg 70 and a leg 72 inclined at an angle of about 60° with the horizontal. The dividers are made from flexible sheet metal. Leg 70 is preferably spot welded or otherwise joined to the lower plate 28.

In FIG. 3, the righthand end of the dividers 48, 50 are innerconnected by a vertical divider 74 secured at its lower end to the plate 28 in any convenient manner such as by welding. In a similar manner, adjacent ends of dividers 52, 54 are innerconnected by a vertically disposed divider 76 joined at its lower edge to the plate 28 in any convenient manner such as by welding. Dividers 74, 76 have a height corresponding to the desired height of chamber 40. The height of leg 72 of each of the dividers is greater than the desired height of chamber 40. Leg 72 is flexible and will flex downwardly when the main plate 26 is installed.

The dividers described above divide the chamber 40 into a continuous labyrinth extending from the inlet 42 to the outlet 44 and defined by flow passages 56, 58, 60, 62, 64, 66, and 68. The width of the flow passages 56–68 decreases in the direction of flow from the inlet 42 to the outlet 44. For example, flow passage 56 may have a transverse width of 3¾ inches whereas flow passage 68 may have a transverse width of 2½ inches. Flow passage 56 is 1.5 to 2.7 times as wide as flow passage 68.

As a result of the progressive decrease in width, the cross-sectional areas of the flow passages also decrease from the inlet to the outlet. Thus, the liquid medium flowing from the inlet 42 to the outlet 44 will increase in velocity as it moves toward the outlet 44. As the velocity of the liquid medium increases, its heat transfer rate to the plate 26 will increase. In this manner, there is compensation provided for the decrease in the temperature of the liquid medium as it flows from the inlet 42 to the outlet 44 whereby the temperature of plate 26 will be substantially uniform across its entire width and length.

In order to support the platen 10 for moving the upper surface of plate 26 toward and away from the plane of the web, the platen 10 may have a notch 78 at the lower rear corner at each end thereof to facilitate receiving a shaft 80. The plate 10 is adapted to pivot about the longitudinal axis of shaft 80 similarly to the pivotable movement disclosed in said U.S. Pat. No. 3,607,523. The actuator for attaining pivotal movement is diagrammatically disclosed herein at 83 and may be of the type as shown in said patent. Further, the plate 10 may be caused to move in a vertical direction toward and away from the plane of the web if desired.

The platen 10 is provided with outwardly extending lugs 82, 84 at opposite ends thereof adjacent the upper edge of the upstream portion of the platen 10. The lugs 82, 84 are adapted to cooperate with adjustment of ballast rolls in the manner of lugs 36, 38 of said U.S. Pat. No. 3,607,523.

The pipe 46 associated with outlet 44 is connected to a manifold conduit 86 by way of a flexible hose 88. Similarly, the corresponding pipe associated with the inlet 42 is connected to a supply conduit 90 by way of a flexible hose 92. Each of the platens of the double facer is similarly connected to the conduits 86, 90.

The liquid circulated through the chamber 40 may be any one of a variety of heat transfer liquids generally characterized as being "oils" and having a boiling point in excess of 600° F. Suitable "oils" which may be used are sold commercially as Mobiltherm 603 or Therminol 55. These so-called oils are non-corrosive, are designed for long life, low maintenance and have high heat transfer capability.

Liquid heated platens in accordance with the present invention utilize liquids at a substantially lower pressure as compared with pressures associated with steam. Thus, lighter piping and conduits as well as less piping conduits may be utilized in connection with oil heated platens. In comparison with steam-heated platens which are generally made of cast iron, the platen 10 is lighter in weight, utilizes thinner walls and facilitates the use of higher temperatures which in turn facilitate a substantial increase in web speed.

Figure 7:
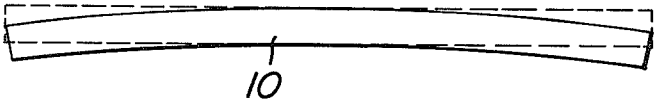
FIG. 7 is a side elevation view of a platen showing schematically the effects of temperature differential.

In FIG. 7, there is schematically illustrated platen 10 in side elevation. It will be noted that the solid line illustration of platen 10 in FIG. 7 illustrates the same as being convex with the ends of the platen 10 being at an elevation below the elevation of the center of the platen. When heat is removed from the main plate 26, due to heat transfer to the web of paperboard, the center of the platen is deflected downwardly so as to lose contact with the web. This condition results in improper formation of the corrugated paperboard.

Figure 8:
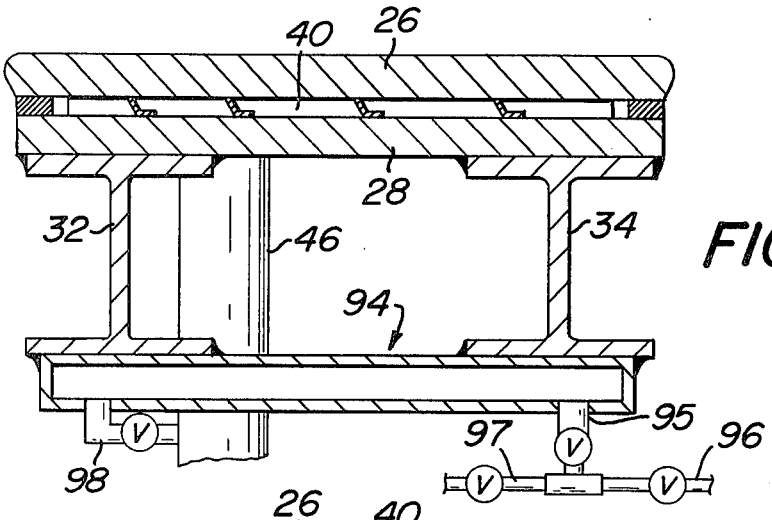
FIG. 8 is a sectional view similar to FIG. 2 but showing one embodiment of a temperature control means.
Figure 9:
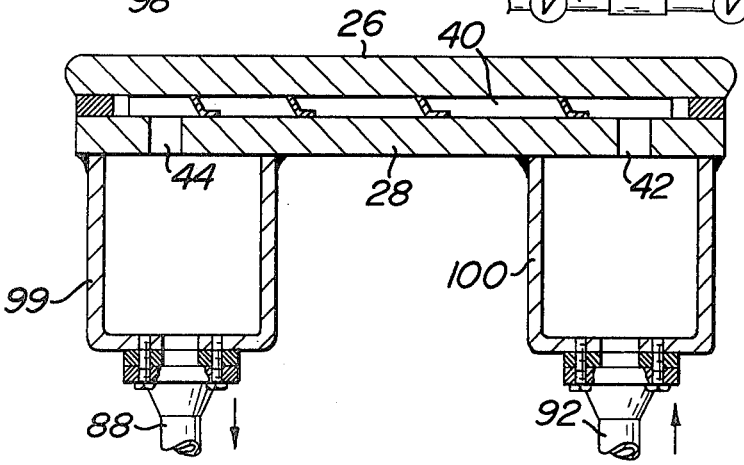
FIG. 9 is a sectional view similar to FIG. 2 but showing another embodiment of a temperature control means.
Figure 10:
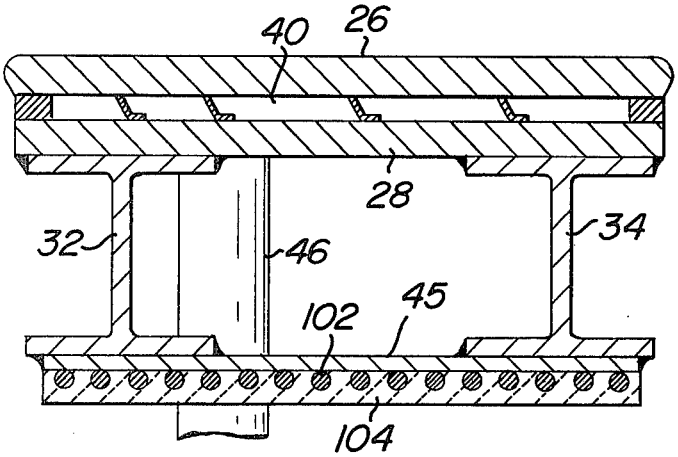
FIG. 10 is a sectional view similar to FIG. 2 but showing another embodiment of a temperature control means.

In FIGS. 8–10, there is illustrated three different embodiments of the present invention wherein a temperature modulation means is provided to cause the platen 10 to remain flat as schematically illustrated in phantom lines in FIG. 7. In connection with each of the embodiments in FIGS. 8–10, the temperature modulation means is associated with the beam means corresponding to beams 32, 34 described above. It is to be noted also in FIGS. 8–10 that the sidewalls 38 have been eliminated for clarity of illustration.

In FIG. 8, the platen 10 is modified by substituting the housing 94 for the brace plates 45. Housing 94 performs the function of brace plates 45 and performs the additional function of facilitating control of the temperature of the beam means.

The housing 94 has a valved inlet conduit 95 communicating with valved conduits 96, 97. Conduit 96 communicates with conduit 86 and conduit 97 may communicate with conduit 90 whereby liquid at different temperatures may be permitted to flow through the housing 94 to its valved outlet conduit 98. Conduit 98 communicates with the outlet pipe 46. During normal operating conditions, cooler liquid from return conduit 86 flows through housing 94 to compensate for any temperature differential between the plates 26, 28 to maintain the plates parallel and flat. During start-up conditions, the liquid should be at a higher temperature and may be obtained from conduit 90 or from any other available source of higher temperature liquid. Control of the valves in the conduits 95–98 may be attained in any convenient manner such as by use of a controller responsive to a thermostat or a strain gauge connected to one or both of the plates 26, 28.

In FIG. 9, there is illustrated another embodiment of the present invention wherein the beam means for the platen 10 is in the form of channels 99, 100. Conduit 92 communicates with the interior of channel 100 which in turn communicates with the inlet 42. Channel 99 communicates with the outlet 44 and conduit 88. In this embodiment, the beam means is heated by the liquid before it enters the chamber 40.

In FIG. 10, there is illustrated another embodiment of the present invention wherein the brace plates 45 are electrically heated by a thermostatically adjustable heating coil 102. Insulation 104 overlies the coil 102.

The provision of temperature modulation of the beam means minimizes the net deflection of the platen 10.

Figure 2:
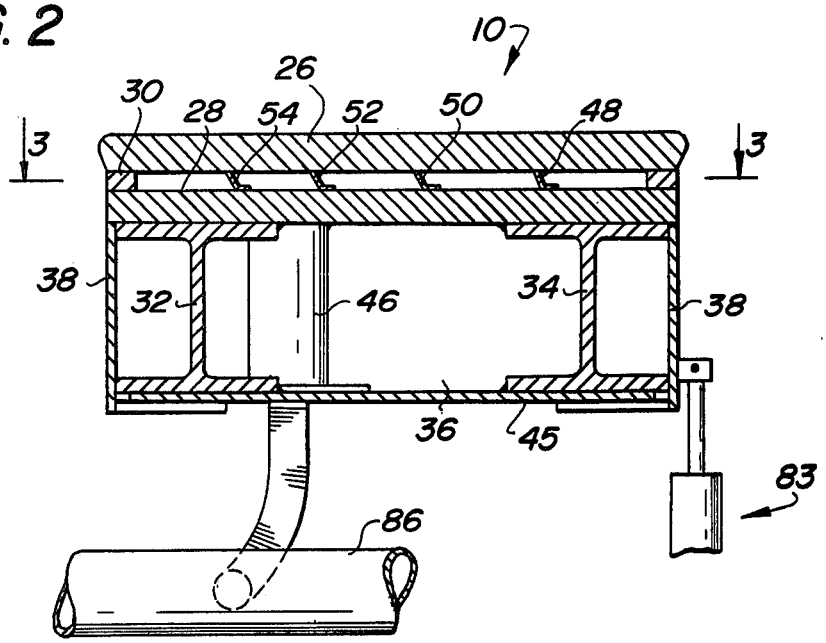
FIG. 2 is a sectional view taken along the line 2—2 in FIG. 1 on an enlarged scale.

In a typical embodiment as shown in FIG. 2, a temperature differential between the upper surface of plate 26 and the lower surface of the beam means 28 may be 100° F. or more with oil at 320° F. flowing at a rate of 30 gallons per minute and a pressure of 50 psi, with the pressure drop through the platen 10 being 5 psi. This condition results in the ends of the platen 10 being below the elevation of the center of the platen by a distance of approximately 0.07 inches. By increasing the temperature of the lower part of the beam means in accordance with the embodiment shown in FIG. 8–10, whereby the beam means is heated up to a temperature slightly below the temperature of the main plate 26 so as to have a temperature differential of not more than about 15° F., the deflection of the ends of the platen 10 may be reduced so as to be below 0.01 inches. Thus, it is not essential that the beam means have the same temperature as the main plate 26.

In the optimum design, the plate and the beam mean should have an operating temperature whereby there is little or no temperature difference. Suitable thermostats and commercially available equipment such as a Wheatstone bridge may be utilized to automatically detect deviations from a desired operating condition and compensate for the same.

The present invention may be embodied in other specific forms without departing from the spirit or essential attributes thereof and, accordingly, reference should be made to the appended claims rather than the foregoing specification as indicating the scope of the invention.

I claim:

1. A platen for heating a web of corrugated board in a double facer and adapted for receiving a heated liquid transfer medium comprising a main plate having a planar outer surface for contact with the web, a second plate below said main plate, a peripheral spacer between said plates to define a shallow chamber for the heated medium, said chamber having an inlet and an outlet, beam means connected to said plate for stiffening said plates, means associated with said beam means for modulating the temperature of said beam means to compensate for a deflection in said main plate caused by a temperature difference between said main plate and said second plate.

2. A platen in accordance with claim 1 wherein said chamber has a height less than the thickness of said main plate.

3. A platen in accordance with claim 1 including means in said chamber defining a labyrinthine flow passage for distribution of the heated medium, the cross-sectional area of said passage decreasing from said inlet to said outlet.

4. A platen in accordance with claim 1 wherein said temperature modulating means includes a hollow housing connected to said beam means and spaced from said shallow chamber, said housing having an inlet and an outlet.

5. A platen in accordance with claim 1 wherein said beam means comprises a plurality of channels, including a first channel communicating with the inlet in said chamber and a second channel communicating with the outlet in said chamber, each of said channels being heated by the heated medium as it flows therethrough.

6. A platen in accordance with claim 1 wherein said temperature modulating means includes an electrical heater coupled to said beam means.

7. A platen for use in a web processing machine so that a surface of the platen may transfer heat ot a web by contact with the web comprising a main plate having a surface for contact with a web, a lower plate having substantially the same periphery as said main plate, means innerconnecting the peripheries of said plates to define a sealed shallow chamber for retaining a heat transfer liquid between said plates, said chamber having an inlet and an outlet communicating therewith through said lower plate, said plates being substantially longer than their width, means in said chamber defining a labyrinthine flow passage having a plurality of longitudinally extending parallel flow portions, the width of said flow portions decreasing in the direction of flow from said inlet to said outlet, a beam means connected to the lower plate to stiffen said plates, said beam means extending longitudinally along said lower plate, and temperature modulating means associated with said beam means for adjusting the temperatures of said beam means to compensate for a deflection caused by a temperature difference of at least 10° F. between said main plate and said lower plate.

8. A platen in accordance with claim 7 wherein said temperature modulating means includes a hollow housing having an inlet and an outlet, said hollow housing being connected to said beam means and being spaced from said shallow chamber.

9. A platen in accordance with claim 7 wherein said temperature modulating means includes said beam means which are hollow, said beam means including a first beam communicating with said inlet and a second beam communicating with said outlet.

10. A platen in accordance with claim 7 wherein said temperature modulating means includes a thermostatically adjustable electrical heater coupled to said beam means.

11. A platen for heating a web of corrugated board in contact therewith and adapted to be heated by a liquid heat transfer medium comprising a main plate having a planar outer surface for contact with the web, a second plate spaced from said main plate and parallel thereto, a peripheral spacer between said plates to thereby define a shallow chamber for the heat transfer medium, a hollow beam means connected to said second plate, said chamber having an inlet and outlet communicating with said hollow beam means, said beam means having an inlet and an outlet, and means associated with said beam means for introducing the heated liquid transfer medium thereto at a rate to compensate for any temperature difference between said main plate and said second plate.

* * * * *